United States Patent [19]

Simmons et al.

[11] Patent Number: 4,469,373

[45] **Date of Patent: * Sep. 4, 1984**

[54] INFANT SEAT FOR TABLES

[75] Inventors: Mark T. Simmons, Providence; Darrell G. Simmons, Smithfield, both of Utah

[73] Assignee: Simmons & Simmons, Inc., Logan, Utah

[ * ] Notice: The portion of the term of this patent subsequent to Mar. 10, 1999 has been disclaimed.

[21] Appl. No.: 352,043

[22] Filed: Feb. 24, 1982

Related U.S. Application Data

[63] Continuation of Ser. No. 134,964, Mar. 28, 1980.

[51] Int. Cl.[3] ..... A47B 83/02

[52] U.S. Cl. ..... 297/174; 297/440

[58] Field of Search ..... 297/174, 440

[56] References Cited

U.S. PATENT DOCUMENTS

| | | | |
|---|---|---|---|
| 2,710,643 | 6/1955 | Wincey et al. | 297/174 |
| 2,855,023 | 10/1958 | Mekeel et al. | 297/174 X |
| 3,126,226 | 3/1964 | Johnson | 297/174 |
| 3,222,104 | 12/1965 | Remington et al. | 297/174 |
| 3,397,010 | 8/1968 | Leimgruber | 297/174 |
| 4,322,110 | 3/1982 | Simmons et al. | 297/174 |

*Primary Examiner*—Francis K. Zugel

*Attorney, Agent, or Firm*—Thorpe, North & Western

[57] ABSTRACT

A portable baby seat has a flexible seat portion hung from a tubular frame for cantilevered mounting on a table edge. A U-shaped horizontal frame member extends through a hollow top seam of the seat's back and sides with end portions of the member extending forwardly for engagement with the top of the table. Each of a pair of lower support arms engage the underside of the table at a point forward of the U-shaped member's engagement. Each support arm is mounted by means of a rotatable sleeve on one of the U-shaped member's end portions. Connected to each sleeve is a curved member having a downwardly extending arm portion, a forwardly extending arm portion, and an upwardly extending end portion. The downwardly extending end portion extends in a direction away from the axis of rotation of the sleeve, while the upwardly extending end portion extends in a direction towards the axis of rotation of the sleeve. The lengths of each of the lower support arms' downwardly extending arm portions is less than one-half of the distance between the sleeves. The length of each of the arms' upwardly extending end portions is less than the length of the downwardly extending arm portions. The baby seat frame folds flat into one plane by inward rotation of the lower support arms.

11 Claims, 4 Drawing Figures

INFANT SEAT FOR TABLES

This application is a continuation of application Ser. No. 06/134,964, filed Mar. 28, 1980.

BACKGROUND OF THE INVENTION

The invention relates to a portable baby seat for cantilevered mounting on a table edge; and more particularly to a baby seat having a frame that folds flat into a single plane for transport and storage, and when mounted on a table edge is safe for infants.

Many collapsible baby or children's seats have been known previously. The following patents, for example, have been uncovered by the inventors and are believed to be relevant prior art to the invention disclosed herein:

| U.S. Pat. No. | Name | Date |
|---|---|---|
| 1,337,103 | Straith | April 13, 1920 |
| 2,451.667 | Ducey | October 19, 1948 |
| 2,493.187 | Ducey | January 3, 1950 |
| 2,509,036 | Cox | May 23, 1950 |
| 2,710,643 | Wincey | June 14, 1955 |
| 3,052,500 | Hyde | September 4, 1962 |
| 3,126,226 | Johnson | March 24, 1964 |
| 3,133,760 | Robinson | May 19, 1964 |
| 3,190,691 | Desjardins | June 22, 1965 |
| 3,222,104 | Remington | December 7, 1965 |

However, none of the above patents have disclosed a design such as to provide a secure and safe cantilevered mounting on a table edge and to permit their frames to be folded flat in a single plane. Moreover, the prior art seats generally have included pivoted seats and frame linkages which, if not carefully set up for use, could pinch or otherwise injure a child. These seats also have been bulky when collapsed and therefore a problem to store. They will not, for example, hang on a wall. In addition, many of the prior seats have included metal fasteners which presented exposed rough edges and which could work loose or be loosened by a child. Some portable baby seats have utilized collapsible fabric seats hung from a frame to minimize these problems but a totally safe cantilevered mounting for a baby seat on a table edge without the described problems has not been accomplished heretofore. Furthermore, most of the prior art portable baby seats are integral in design and construction, thereby making it difficult and cumbersome to disassemble them for cleaning or repair.

SUMMARY OF THE INVENTION

A principle object of the present invention is to provide a portable baby seat that may be easily and safely cantilevered on the edge of a table.

A further object of the present invention is to provide such a portable baby seat that may be compactly folded into a single plane, thereby facilitating storage and transport of the seat.

Another object of the present invention is to provide a baby seat that does not utilize fasteners, hinged members, or similar items that may have rough edges or surfaces which, when exposed or accessible, could cut, pinch, or otherwise harm a user of the seat.

An additional object of the present invention is to provide a portable baby seat that may be easily disassembled by an adult for purposes of cleaning or repair.

The above and other objects of the invention are realized in an embodiment of a portable baby seat adapted for cantilevered mounting on the edge of a table. The seat includes a flexible seat portion of fabric or plastic hung on a tubular frame. The frame may be folded flat into a single plane for storage and transport. The frame is made of three main members: a generally U-shaped horizontal member which extends through a hollow top seam of the seat's back and sides and which has its end portions extending forwardly for engaging the top of the table; and a pair of lower support arms, each rotatably mounted around one of the end portions of the U-shaped horizontal member, and each adapted to engage the underside of the table at a point forward of the U-shape member's engagement with the top of the table. Rotational mounting of each support arm is realized by use of a sleeve telescopingly inserted over one of the U-shaped member's end portion. Thus mounted, each support arm may rotate about an axis. That is generally defined by the longitudinal centerline of the respective end portion of the U-shaped member.

Welded or otherwise connected to each sleeve is a curved member having a downwardly extending arm portion, a forwardly extending arm portion, and an upwardly extending end portion. The downwardly extending arm portions extend away from the axis of rotation; the forwardly extending arm portions extend in a direction that generally parallels the axis of rotation, and the upwardly extending end portions extend back towards the axis of rotation. The lengths of each of the lower support arms' downwardly extending arm portion and upwardly extending end portion are such that the support arms may be easily rotated from their vertically oriented position of use to a horizontally oriented position of storage wherein the support arms lie in a single plane between the end portions of the U-shaped horizontal member.

Rubber stops are mounted on the tube ends of the frame for protection of users from injury and to provide an anti-slip engagement of the end portions of the U-shaped member and the outer end portions of the lower support arms with the table. The rubber stops inserted on the end portions of the U-shaped member further serve as a stopper to normally prevent the sleeves of the support arm from being pulled off of the ends of the U-shaped member. When disassembly of the seat is desired, however, the rubber stops may be pulled off of the end portions of the U-shaped member, thereby allowing the sleeves of each support arm to slide thereoff.

With one or both of the support arms removed from the U-shaped member, the flexible seat portion (which typically includes a hollow seam around its upper edges through which the U-shaped member passes) may also be removed therefrom, thereby allowing the seat to be washed, mended, or replaced.

BRIEF DESCRIPTION OF THE DRAWINGS

The above and other objects, features, and advantages of the invention will be more apparent from the following more particular description presented in connection with the accompanying drawings, in which.

and

Figure 1:
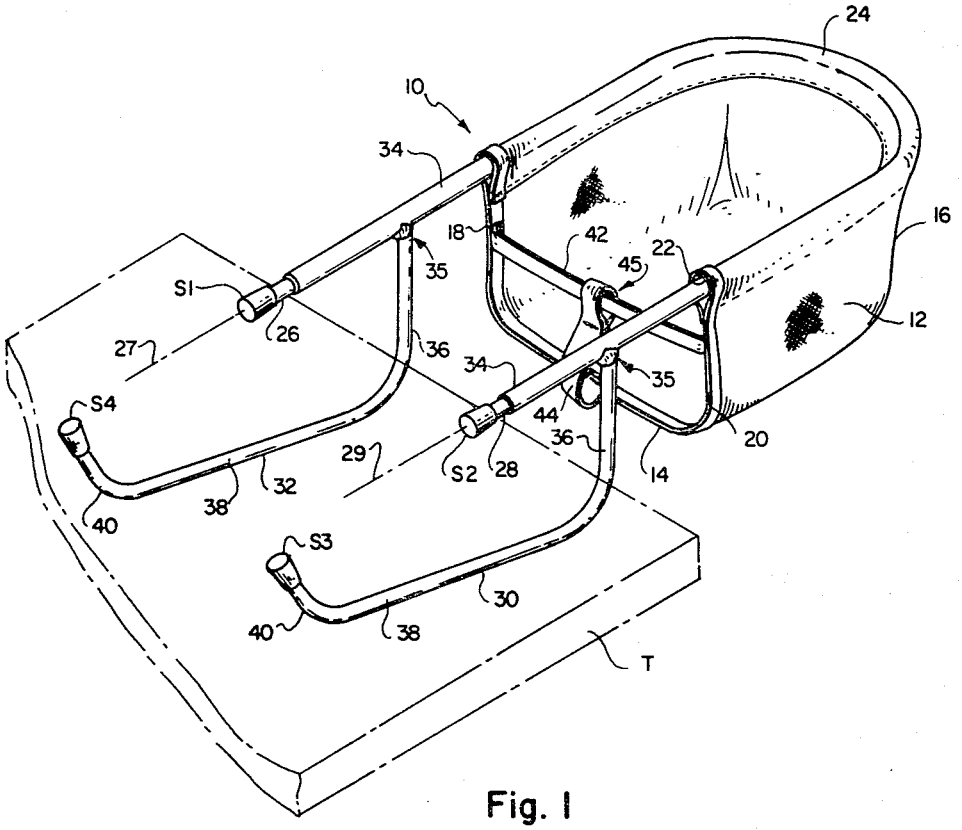
FIG. 1 is a perspective view of a portable baby seat constructed according to the principles of the invention with a table edge upon which it is mounted shown in phantom.
Figure 2:
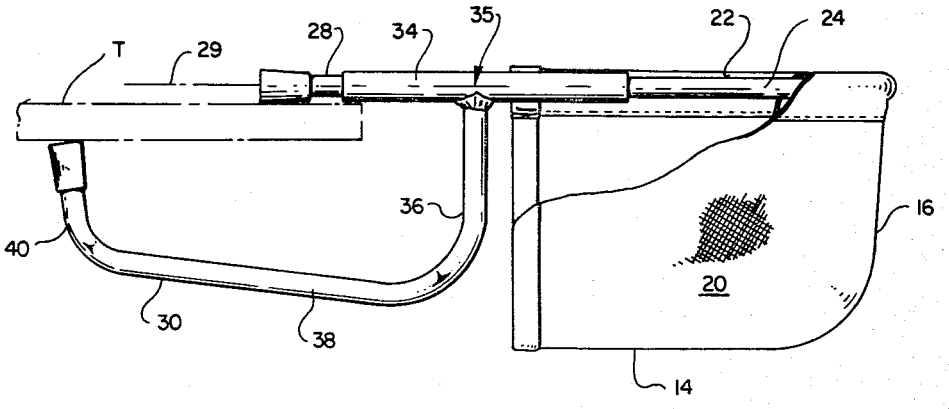
FIG. 2 is a side elevational view of the portable baby seat of FIG. 1 with a portion of the seat portion cutaway.
Figure 3:
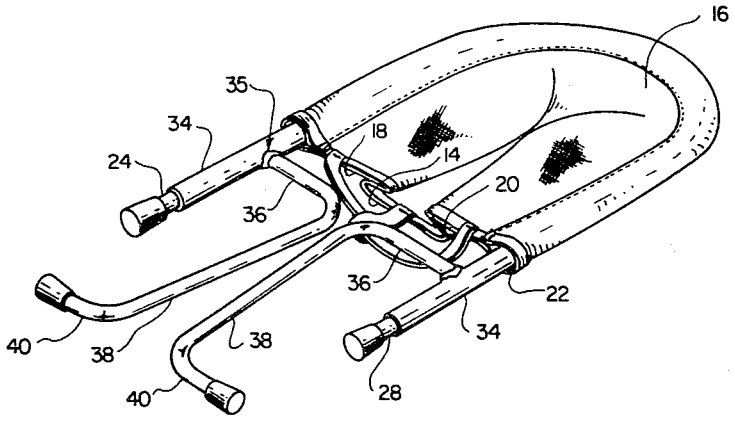
FIG. 3 is a perspective view of the portable baby seat of FIGS. 1 and 2 shown collapsed and folded flat for transport and storage.
Figure 4:
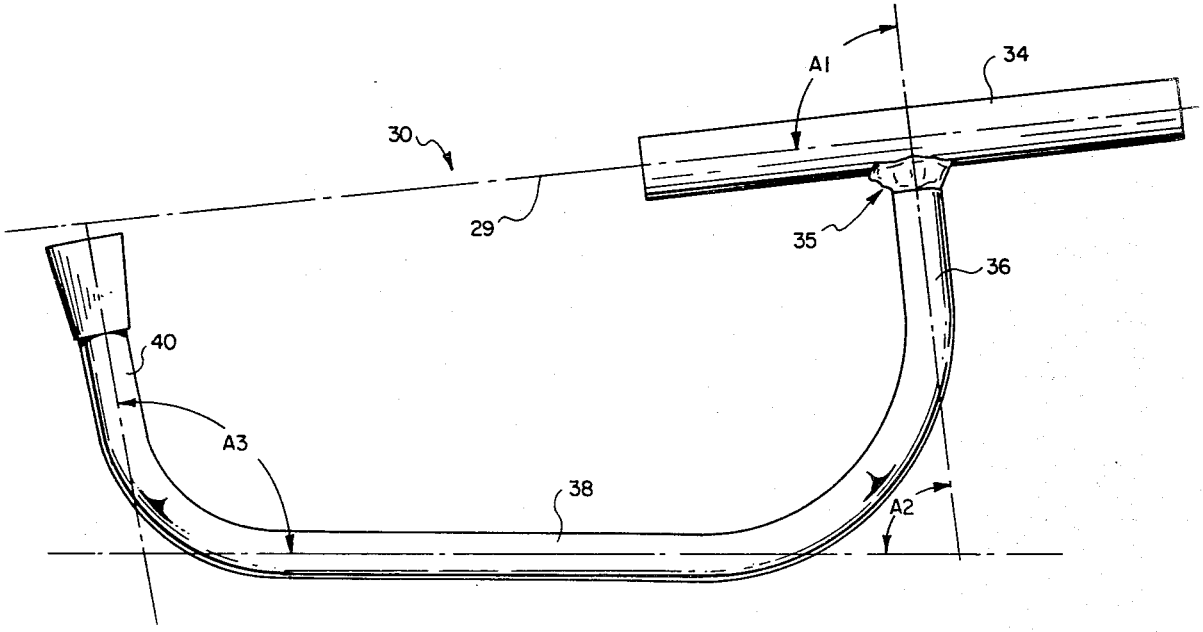

FIG. 4 is a side elevational view of a lower support arm of the portable baby seat of FIGS. 1–3.

DESCRIPTION OF THE PREFERRED EMBODIMENT

Shown generally at 10 is a portable baby seat constructed according to the principals of the present invention. The baby seat 10 is adapted for cantilevered mounting on the edge of a table T. The seat 10 includes a flexible seat portion 12 of fabric or plastic hung on a tubular U-shaped member 24. The seat portion 12 has a generally horizontal bottom 14, a back 16 and sides 18 and 20. Around the top of back 16 and sides 18 and 20 is a hollow seam 22.

The tubular frame includes a horizontal U-shaped member 24 having end portions 26 and 28. Rubber stops S1 and S2 are secured on the end portions 26 and 28 respectively for prevention of injury on the tube end edges and to provide an anti-slip engagement of the end portions 26 and 28 of the U-shaped member with the top of the table T. The horizontal U-shaped member 24 extends through a hollow seam 22 placed around the upper edges of the back 16 and sides 18 and 20 of the seat portion 12. The seat 12 thus hangs from the U-shaped member 24 with end portions 26 and 28 extending forwardly from the top of seat sides 18 and 20.

The frame includes a pair of lower support arms 30 and 32 for engagement with the underside of Table T. The lower support arms 30 and 32 each include an upper generally horizontal sleeve 34 having two open ends and an intermediate tubular section which is telescopingly mounted for rotation about an axis on one of the end portions 26 or 28 of the U-shaped horizontal member 24. The cross-section of the end portions 26 and 28 is circular, as is the cross-section of the sleeve 34. The outer diameter of the end portions 26 and 28 is selected to be only slightly smaller than the inner diameter of the sleeve portion 34. Thus, there is a close fit between the two and the axis of rotation of each sleeve is approximately the longitudinal center line 27 and 29 of each end portion 26 and 28 respectively of the U-shaped horizontal member 24. It will also be apparent from the figures that this telescopic attachment permits the sleeve 34 to be slideably adjusted for position along the axis of the straight U-shaped member 24. This permits adjustment of the seat 12 with respect to the table by allowing the U-shaped member 24 to be slid forward or rearward through the sleeve, shifting the ends 26 and 28 along center lines 27 and 29. These slideable and rotational features are permitted by reason of the uniform inner diameter of the sleeve to rotate about and slide along the axis 27 and 29 of the U-shaped member.

The lower support arms 30 and 32 each include a curved member having a downwardly extending arm portion 36, a forwardly extending arm portion 38, and an upwardly extending end portion 40. The downwardly extending arm portion 36 is welded, brazed, or otherwise rigidly secured and connected to the sleeve 34 at an area shown generally as 35. The lower part of the downwardly extending arm portion 36 curves and integrally connects to the forwardly extending arm portion 38. The forwardly extending arm portions 38 are of such length that they extend under the table to a position forward of the end portions 26 and 28 of the U-shaped horizontal member. The lower support arms 30 and 32 curve at the end of their respective forwardly extending arm portions 38 to form an upwardly extending end portion 40. Each upwardly extending end portion 40 extends towards the direction of the axis of rotation of its respective sleeve 34. Rubber stops S3 and S4 are placed on the ends of the upwardly extending end portions 40 to provide an anti-slip engagement with the underneath side of the table T.

The sleeve portion 34, arm portions 36 and 38, and end portion 40 all lie in a single plane, as best shown in FIG. 4, that plane being the plane of the paper on which FIG. 4 appears. In the preferred embodiment of the invention, the angle A1 between the downwardly extending arm portion 36 and the axis of rotation of the sleeve 34 is typically between 85 and 89 degrees, the angle A2 between the downwardly and forwardly extending arms is between 77 and 81 degrees, and the angle A3 between the forwardly and upwardly extending arms is between 99 and 103 degrees.

The lower support arms' upwardly extending end portions 40 each are of a length less than the downwardly extending arm portion 36. Also, the downwardly extending arm portions 36 of each of the lower support arms 30 and 32 are less than one-half of the distance between the two sleeves 34. Accordingly, as shown best in the perspective view of FIG. 3, the entire tubular frame will lie within a single plane and between the sleeves 34 when the lower support arms 30 and 32 are rotated approximately ninety degrees from their vertically oriented position of use to their horizontally oriented position of storage.

As seen in FIG. 3, the portable baby seat 10 when folded is flat enough to be easily stored and can, if desired, be hung on a wall for this purpose. In addition, because of its lack of fasteners and the use of rubber stops S1, S2, S3, and S4 on the ends of the U-shaped horizontal member 24 and the lower support arms 30 and 32 there is little danger of injury to a child or any other person who handles it.

Important to the safety of the baby seat 10 is the non-slip engagement of the rubber stops S3 and S4 of the upwardly extending end portions 40 with the underside of table T at a location well forward of the engagement of the rubber stops S1 and S2 of end portions 26 and 28 of U-shaped horizontal member 24 with the top of tube T. This is because the weight of a child sitting in seat 10 will create a downward moment of force about the end portion 26 and 28 which will be positively resisted by the end portions 40 of the lower support arms 30 and 32 as they engage the underside of table T. The child is thus safely and securely cantileverly mounted within the seat with the table edge in front of him. A front horizontal web 42 (FIG. 1) attached at its ends to sides 18 and 20 and a vertical web 44 attached approximately in the center of a front edge of the bottom 14 and midway along the web 42 further insures that a safe and convenient portable baby seat is provided. Both the web 42 and the web 44 are made of a flexible fabric or plastic material. Typically, the vertical web 44 is not fastened directly to the web 42, but rather loops around it and is secured to itself as shown at 45. This allows the web 44 to move laterally, if necessary, when an infant is being inserted or removed from the seat.

The preferred embodiment illustrates attachment of stops S1 and S2 at end portions of the U-shaped member; however, it will be apparent to one skilled in the art that resilient stops could likewise be positioned near the end portion of the U-shaped member, for example at the forward ends of the respective sleeves 34. In this case, additional means would be coupled to the U-shaped member for preventing the sleeves from sliding inadvertently free from their telescopic mount on the U-shaped member. From FIG. 2, it would be apparent that a rubber stop could be positioned around the periphery of the forward end of the sleeve 34 (shown positioned over the edge of table T) and operates similar to the stop attached at the end 28 of the U-shaped member as specifically illustrated).

The stops S1 and S2 prevent sleeves 34 from slipping off the end portions 26 and 28 of U-shaped member 24. However, should it ever be necessary to remove the fabric or plastic seat portion 12 from the U-shaped member 24—as, for example, to have the seat portion 12 washed or otherwise cleaned—one or both of the stoppers S1 or S2 could be removed from end portions 26 or 28, thereby allowing the sleeve 34 to be pulled off the end portion of the U-shaped member 24. Once the sleeve 34 is removed, the seat portion 12 may also be slipped off of the U-shaped member 24, and cleaned, mended, or replaced. The baby seat 10 is thus easily disassembled. Of course, once disassembled, it may be just as easily reassembled.

While the invention herein disclosed has been disclosed by means of a specific embodiment and application thereof, numerous modifications and variations could be made thereby by those skilled in the art without departing from the spirit and scope of the present invention. It is therefore to be understood that within the scope of the appended claims, the invention may be practiced otherwise than as specifically described herein.

What is claimed is:

1. A portable folding baby seat for cantilevered mounting on the edge of and above the plane of a table when in a position of use and for folding into a single plane when in a position of storage, said portable folding baby seat comprising:

a flexible seat portion hung from a frame, said flexible seat portion having a generally horizontal bottom and a generally vertical back and sides when said baby seat is in said position of use, and said flexible seat portion being collapsible into a single plane when said baby seat is in said position of storage:

said frame comprising:

a generally U-shaped member from which said flexible seat portion hangs, said U-shaped member lying in a first plane adapted for positioning above the plane of the table, said U-shaped member including end portions extending forwardly from the top of each side of said flexible seat portion for engagement with the top of said table, and a pair of lower support arms for engagement with the underside of said table at points that are forward from the most forward points at which said end portions of the U-shaped member engage with the top of said table, each of said lower support arms including:

an upper sleeve telescopingly and slideably mounted on a respective end portion of said U-shaped member for slideable positioning and rotation along the axis of said member, said sleeve having two open ends and an intermediate, cylindrically shaped tubular section with a uniform inner diameter sufficiently large to permit the sleeve to rotate about and slide along the axis of the U-shaped member, and a curved member having:

a downwardly extending arm portion having one end connected to the intermediate portion of said sleeve and having a length less than one-half of the distance between said sleeves, said downwardly extending arm portion extending in a direction away from said axis of rotation of said sleeve, a forwardly extending arm portion connected to said downwardly extending arm portion, and an upwardly extending end portion connected to said forwardly extending arm portion, said upwardly extending arm portion extending in a direction towards said axis of rotation of said sleeve;

whereby said downwardly and forwardly extending arm portions and said upwardly extending end portion of each lower support arm lie in a second plane that is rotated so as to be generally perpendicular to the plane of said U-shaped member when said baby seat is in its position of use, and further whereby said second plane is rotated so as to lie in said first plane when said baby seat is in its position of storage;

said frame further comprising stops made from a resilient material, such as rubber, secured around the periphery of the U-shaped or sleeve members of the frame and a point forward of the point of connection of the downwardly extending arm portion and the sleeve near the end portions of said U-shaped member and said frame further including means coupled to the U-shaped member for preventing the sleeves which are telescopingly mounted for rotation from being inadvertently removed therefrom while allowing disassembly of the lower support arms from the U-shaped member, as well as removal of the flexible seat portion when detached.

2. A portable baby seat as defined in claim 1 wherein the length of said upwardly extending end portions of each of said lower support arms is less than the distance of said downwardly extending arm portions of said lower support arms.

3. A portable baby seat as defined in claim 1 wherein the U-shaped horizontal member and the lower support arms are tubular in construction.

4. A portable baby seat as defined in claim 3 further including rubber stops secured to the end portions of said U-shaped member and said upwardly extending portions of said lower support arms.

5. A portable baby seat as defined in claim 4 wherein said rubber stops secured to said end portions of the U-shaped member prevent the sleeves which are telescopingly mounted for rotation about said end portions from being removed therefrom.

6. A portable baby seat as defined in claim 5 wherein said rubber stops are detachably secured to said end portions of said U-shaped member, thereby allowing said rubber stops to be removed when disassembly of the lower support arms from the U-shaped member, as well as removal of the flexible seat portion from the U-shaped member, is desired.

7. A portable baby seat as defined in claim 1 further including:

a front horizontal flexible web attached at each end to a side of said flexible seat portion, and a front vertical flexible web having its upper end looped around said horizontal web and its lower end attached to the bottom of said flexible seat portion.

8. A portable baby seat as defined in claim 7 wherein the flexible seat portion is of a plastic material.

9. A portable baby seat as defined in claim 7 wherein the flexible seat portion is of a fabric material.

10. A portable baby seat as defined in claim 1 wherein said flexible web seat portion includes a hollow seam at the top of its back and sides through which said U-shaped horizontal member extends to hang said seat portion.

11. A portable baby seat as defined in claim 1, wherein the stops are detachably secured to the end portions of the U-shaped member and operate as the means for preventing the sleeves from being removed.

* * * * *